US006755698B2

(12) United States Patent
Kaiser et al.

(10) Patent No.: US 6,755,698 B2
(45) Date of Patent: Jun. 29, 2004

(54) UNIVERSAL PRESSED SCREEN FOR VARIOUS CONNECTOR DESIGNS

(75) Inventors: Klaus Kaiser, Markgroeningen (DE); Markus Michels, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/188,218

(22) Filed: Jul. 2, 2002

(65) Prior Publication Data

US 2003/0064628 A1 Apr. 3, 2003

(30) Foreign Application Priority Data

Jul. 7, 2001 (DE) ..... 201 11 337 U

(51) Int. Cl.[7] ..... H01R 4/02
(52) U.S. Cl. ..... 439/874; 439/881
(58) Field of Search ..... 439/874–876, 439/877, 881

(56) References Cited

U.S. PATENT DOCUMENTS 3,636,495 A * 1/1972 Forsyth, Jr. ..... 439/106
5,314,361 A * 5/1994 Ney et al. ..... 439/874
5,357,074 A * 10/1994 Pawlikowski ..... 219/85.18
5,824,955 A * 10/1998 Saiso et al. ..... 174/88 R
6,471,365 B2 * 10/2002 Wang et al. ..... 362/84
6,491,553 B2 * 12/2002 Northey ..... 439/874
6,538,203 B1 * 3/2003 Nolle et al. ..... 174/84 R

* cited by examiner

*Primary Examiner*—Gary F Paumen
(74) *Attorney, Agent, or Firm*—Kenyon & Kenyon

(57) ABSTRACT

A multipole electrical plug connector which is provided with a mating connector for a disconnectable connection having one or more contact elements, as well as electrical strip conductors which lead to the contact elements, and which jointly form a pressed screen designed as a one-piece part. The strip conductors at their free ends are provided with receptacles, into which contact elements may be plugged in. Due to a single flexibly designed pressed screen having appropriate receptacles, it is possible to cost-effectively manufacture various plug connectors having different contact element arrangements.

5 Claims, 3 Drawing Sheets

UNIVERSAL PRESSED SCREEN FOR VARIOUS CONNECTOR DESIGNS

FIELD OF THE INVENTION

The present invention relates to a multipole electrical plug connector which is provided with a mating connector for a disconnectable connection having essentially one or more contact elements, as well as electrical strip conductors which lead to the contact elements and which jointly form a pressed screen designed as a one-piece part.

BACKGROUND INFORMATION

Plug connectors of the general type mentioned above are already available in innumerable designs. They have a plurality of contact elements which are positioned in multiple rows, as well as side by side. In particular plug connectors having a pressed screen, i.e., having individual strip conductors leading to the contact elements punched out of strip conductor sheet metal, are, generally, embedded in or injected into a plastic carrier. The contact elements jointly with the strip conductors are also punched out of strip conductor sheet metal, and are subsequently appropriately bent in an additional manufacturing process.

Due to the fact that the contact elements and the strip conductors are manufactured together in one punching operation, it is necessary to make the material thickness of the strip conductors equal to the thickness of the contact elements. Thus, the material thickness of the strip conductor is overdimensioned. It is also necessary to manufacture a separate punching tool for each contact element design. This means that for different configurations of a plug connector, different punching tools must be available.

SUMMARY

An object of the present invention is to provide a plug connector by using one pressed screen which is usable universally.

In accordance with an example embodiment of the present invention, a universally usable pressed screen is manufactured in one operation, the pressed screen being suitable for a plurality of positioning possibilities of contact elements. As a function of the appropriate assembly diagram of the contact elements, one or more receptacles, provided at the free ends of the strip conductors, may optionally be assigned to the contact elements.

An advantage of the example embodiment of the present invention may be that a single pressed screen is adjustable to various connector designs, i.e., different arrangements of the contact elements. The contact elements necessary for the particular plug connector are plugged into the receptacles and fixedly attached by turning; the receptacles may be in the form of a through-hole, for example, having a rectangular cross-section. The unit, including the pressed screen or the strip conductor, together with the contact elements, is extrusion coated in an additional operation using plastic, so that the contact elements are fixedly joined with the particular strip conductors.

In contrast to the available variations, a considerable cost advantage may result from the fact that only a small number of punching tools is necessary in order to manufacture a plurality of connector designs.

An additional advantage of the example embodiment of the present invention may be the reduction of the material thickness of the pressed screen, since it is not bound to the material thickness of the contact elements. This entails a cost advantage with regard to a lower material usage.

Another advantage of the example embodiment of the present invention may be that the contact elements are treatable before they are joined with the pressed screen. The contact elements may be advantageously treated by using a cost-effective drum coating method. Since conventionally, strip conductor and contact elements have a one-piece design, it was necessary to run the finished component through a treatment bath. Since the strip conductors are also treated in this way, more coating material is used as may be necessary.

DETAILED DESCRIPTION

Figure 1:
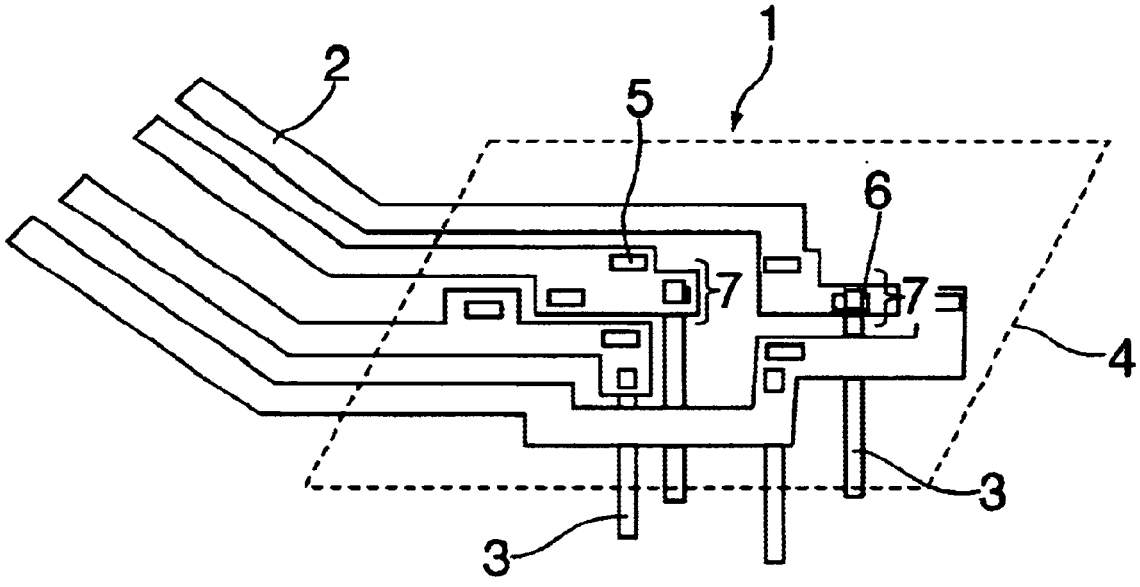
FIG. 1 shows a perspective view of the pressed screen according to an example embodiment of the present invention having a first possible arrangement of contact elements.
Figure 2:
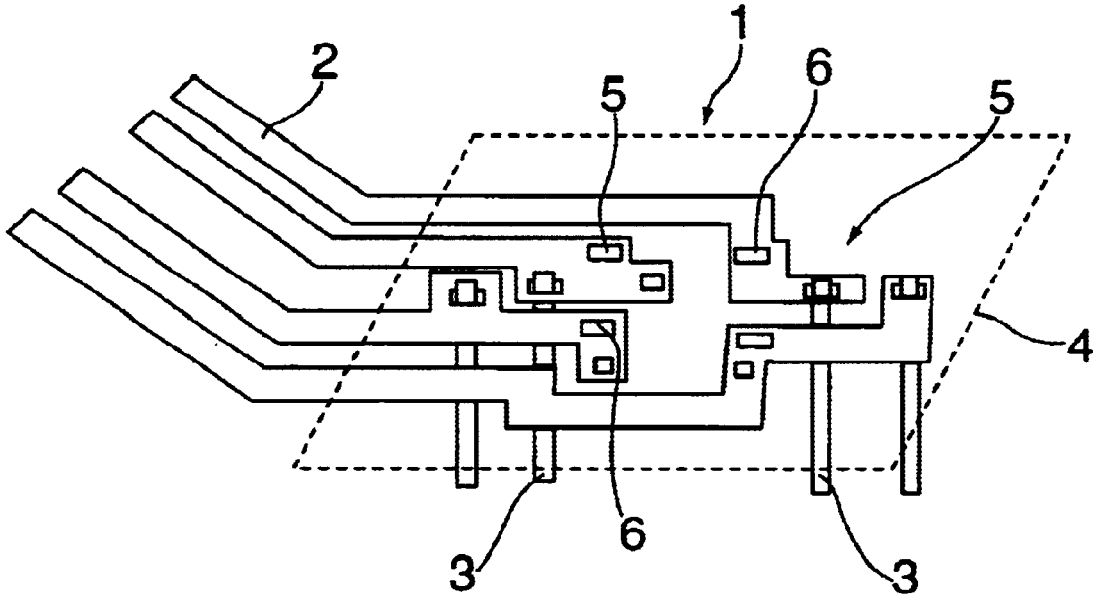
FIG. 2 shows a perspective view of the pressed screen according to FIG. 1 having an additional possible arrangement of contact elements.
Figure 3:
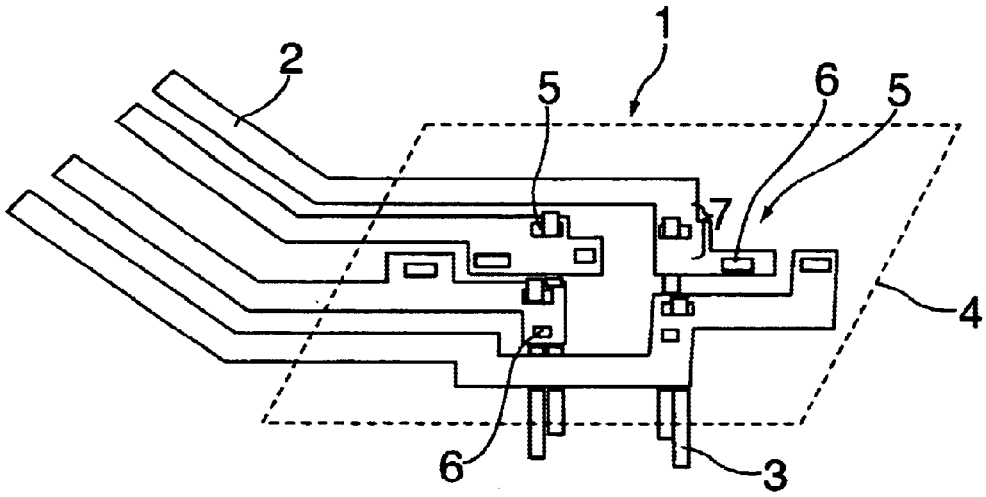
FIG. 3 shows a perspective view of the pressed screen according to FIG. 1 having another possible arrangement of contact elements.

The same pressed screen 1, including different strip conductors 2, is illustrated in FIGS. 1 through 3. Strip conductors 2 end, with one side closed, at a connector element (not shown in greater detail), the additional free ends, depending on the possible arrangement of contact elements 3, ending in a defined plane 4 and having receptacles 5 at their free ends.

Receptacles 5 include rectangularly formed through-holes 6, which are provided for receiving contact elements 3, which are preferably designed as plug-in pins.

The fastening of contact elements 3 to receptacles 5 may be implemented by twisting part 7 which protrudes from through-hole 6. By extrusion coating pressed screen 1 in its pre-assembled state, a final fastening of contact elements 3 is achieved with regard to pressed screen 1.

Due to a single flexibly designed pressed screen 1 which has appropriate receptacles 5, it is possible to cost-effectively manufacture a variety of connectors having different contact element arrangements.

What is claimed is:

1. A multipole electrical plug connector, comprising:

contact elements adapted to engage contacts of a mating connector; electrical strip conductors which lead to the contact elements, free ends of the strip conductors being provided with receptacles into which the contact elements are inserted, the contact elements being welded to the strip conductors.

2. A multipole electrical plug connector, comprising:

contact elements adapted to engage contacts of a mating connector; electrical strip conductors which lead to the contact elements, free ends of the strip conductors being provided with receptacles into which the contact elements are inserted, the contact elements being soldered to the strip conductors.

3. A multipole electrical plug connector, comprising:

contact elements adapted to engage contacts of a mating connector;

electrical strip conductors which lead to the contact elements, free ends of the strip conductors being provided with receptacles into which the contact elements are inserted, the contact elements being riveted to the strip conductors.

4. The plug connector as recited in any of claims 1–3, wherein the receptacles are designed as through-holes into which the contact elements are introducible.

5. The plug connection as recited in claim 4, wherein a cross-section of each of the through-holes has a rectangular design.

* * * * *